US008246012B2

(12) United States Patent
Pasqualini

(10) Patent No.: US 8,246,012 B2
(45) Date of Patent: Aug. 21, 2012

(54) CONSTRUCTION SITE FENCE PANEL FOOT BOOT

(76) Inventor: Tony L. Pasqualini, Port Moody (CA)

( * ) Notice: Subject to any disclaimer, the term of this patent is extended or adjusted under 35 U.S.C. 154(b) by 237 days.

(21) Appl. No.: 12/380,547

(22) Filed: Jun. 1, 2009

(65) Prior Publication Data

US 2010/0301294 A1 Dec. 2, 2010

(51) Int. Cl.
*E04H 17/16* (2006.01)

(52) U.S. Cl. ..... 256/1; 256/24; 256/31; 404/6; 404/9; 404/16; 40/607.1

(58) Field of Classification Search ..... 404/13, 404/14, 16, 9, 6; 40/607.1; 248/519, 539, 248/551; 182/113; 256/DIG. 6, 66, 65.14, 256/65.11, 65.12, DIG. 5, 24, 25, 13.1, 1, 256/31; 52/169.13, 170, 297, 298
See application file for complete search history.

(56) References Cited

U.S. PATENT DOCUMENTS

| | | | | |
|---|---|---|---|---|
| 2,611,909 | A * | 9/1952 | Dillon et al. | 256/31 |
| 5,437,907 | A * | 8/1995 | Peil et al. | 428/143 |
| 5,488,792 | A * | 2/1996 | Kwok | 40/612 |
| 5,860,386 | A * | 1/1999 | Schwab et al. | 116/63 P |
| 6,540,209 | B2 * | 4/2003 | Ross | 256/68 |
| 6,935,059 | B1 * | 8/2005 | Chang | 40/607.02 |
| 6,981,817 | B2 * | 1/2006 | Braverman | 404/9 |
| 7,423,552 | B2 * | 9/2008 | Sherman et al. | 340/933 |
| 7,849,617 | B2 * | 12/2010 | Intagliata et al. | 40/608 |
| 2006/0113516 | A1 * | 6/2006 | Higgs et al. | 256/1 |

FOREIGN PATENT DOCUMENTS

| | | | |
|---|---|---|---|
| EP | 355440 | A1 * | 2/1990 |
| EP | 560539 | A1 * | 9/1993 |

* cited by examiner

*Primary Examiner* — Daniel P. Stodola
*Assistant Examiner* — Matthew R McMahon

(57) ABSTRACT

A construction site fence, or barrier foot plate base unit or foot cover attachment for separating the barrier from traffic and to guide traffic. The base unit attaches a traffic delineator thereon top of the base unit. Also, the base unit may include a pad that is tapered away from the construction site barrier panel foot, creating a gentle sloping ramp, including a combination of the sloping ramp and the delineator mount.

3 Claims, 8 Drawing Sheets

CONSTRUCTION SITE FENCE PANEL FOOT BOOT

TECHNICAL FIELD

The invention relates to a construction site fence, or barrier, foot plate base unit or "boot", and more specifically to a construction site fence panel foot cover attachment for separating the fence from traffic and to guide traffic so as to safely allow local traffic such as foot traffic and additionally to allow wheelchairs and scooters to travel safely over the foot.

BACKGROUND OF THE INVENTION

A construction site often requires a fence to help protect the site from materials being stolen or to keep traffic at a distance from the site or to prevent accidence such as people falling into an excavation.

Once a fence is installed around a construction site or along a construction site road frontage, there is a potential for traffic that is unfamiliar with the new barrier to come into contact with the fence or the fence panel feet. The typical construction site fence has panels that are roughly 7 feet tall by 10 feet long. The bottom corners of the panels are placed over a fence panel foot, where the foot allows additional panels to be attached and supports them vertically. The outermost part of the is "foot" is generally the furthest point away from the fence panel bottom and is subject to contact by close moving automobiles and or foot traffic, especially when the fence panels are erected on or near a sidewalk or walkway adjacent a street or a road.

To make pedestrians and drivers aware of the barrier it is beneficial to stand traffic delineators adjacent to the periphery of the fence so that traffic can easily see the temporary barrier. The most common approach currently in use is to place a traffic delineator, usually having a rubber base, next to or on top of the fence foot. Sitting on the fence foot allows the traffic delineator to often sit unlevel and the delineator can be easily knocked or moved out of position, or possibly stolen.

The present invention provides a construction site barrier foot plate base where the base can be readily attached to a traffic delineator without any major changes to a standard traffic delineator or any changes to the fence panel foot, and the base can be subsequently removed from the fence panel foot easily once the construction site fence is removed after site completion.

In a second embodiment of the present invention a construction site fence panel foot plate is covered by a gradually sloping base.

The gradually sloping base is readily attached to a fence panel foot plate as well without any changes to the fence panel foot plate and can also be subsequently removed from the fence panel foot when the construction site fence is removed after site completion.

In a third embodiment of the present invention it is sometimes an advantage to combine the sloping base unit as just mentioned with the ability to attach a traffic delineator as with the base unit as previously mentioned.

Accordingly, it is an object of the present invention to provide a construction site fence boot or base unit that easily attaches to a fence panel foot plate.

Another object of the present invention is to provide improved guidance for automobile traffic to help prevent contact with the fence panel by providing a secure attachment of a highly visible traffic delineator.

Yet another object of the present invention is to provide protection for pedestrian, wheelchair or scooter traffic from contacting the fence panel foot.

Still another object of the present invention is to provide for cleaner, neater look around the construction site fence.

A further object of the present invention is to provide a construction site fence panel foot base with added visibility.

The construction site fence foot plate base unit of the present invention has other objects and features of advantage which will become apparent from and are set forth in more detail in the accompanying drawings and following details.

DISCLOSURE OF THE INVENTION

The construction site fence panel foot base unit of the present invention is designed to cover the outward protruding fence foot plate, and comprises briefly, a base unit that includes a traffic delineator mount that longitudinally extends up from the base. The base unit attaches to the fence foot plate through an aperture, where the aperture slides over the fence panel foot plate. The unit includes a fastener which may be of various types. The fastener generally projects downward into the inside of the aperture so as to contact the fence panel foot plate when applied.

The base unit attaches various types of traffic delineators to the top of the base unit, usually by a bolt or other fastener running through the top portion of the base unit so that the delineator is attached to stand vertically from the top of the base unit. The delineator is generally a high visibility reflective component which are readily available through many industrial suppliers.

The base unit can also be attached in various other ways such as clamping or tying, such as with nylon ratchet straps or wiring in place.

In another embodiment of the present invention, the construction site fence panel foot base unit of the present invention is designed to cover the fence foot plate with a gradually sloping pad, and comprises briefly, a base unit having an aperture that slides over the fence foot plate. This base unit is generally made of plastic or rubber and tapers away from the top over the aperture to the edges of the unit. The base unit would reach out at least a few inches from the foot plate to provide a gentle slope or ramp area.

This style of "boot" provides a means for foot traffic, wheelchairs and scooters, to ride up over the boot eliminating potential tripping by pedestrians, and bumping by these smaller vehicle wheels, in the area of normal foot and pedestrian type traffic.

This aspect of the boot may include a high visibility reflective surface around it's perimeter.

As well, this type of boot can also be attached to the foot plate in various ways such as bolting, clamping or tying, such as with nylon ratchet straps or wiring in place.

In a third embodiment of the present invention, the two types of base units are combined so as to provide a more visible and further effective base unit that can be used in an area where all types of traffic can be expected. This base unit has a traffic delineator mount attached near the center of the pad of the base unit, where the delineator mount protrudes above the pad and includes a bolt hole through the delineator mount in the same manner to attach any commercially available traffic delineator.

As well, this type of boot can also be attached to the foot plate in various ways such as bolting, clamping or tying, such as with nylon ratchet straps or wiring in place.

Also, a "puzzle" screw head, or a non-standard key on a tamperproof set screw used on the base unit fastener(s) can further prevent stolen base units and traffic delineators.

BRIEF DESCRIPTION OF THE DRAWINGS

Advantages of the present invention will become more fully appreciated as the same becomes better understood when considered in conjunction with the following detailed description of an illustrative embodiment and accompanying drawings, in which like reference characters designate the same or similar parts throughout the several views, and wherein.

DETAILED DESCRIPTION OF THE PREFERRED EMBODIMENTS

Figure 1:
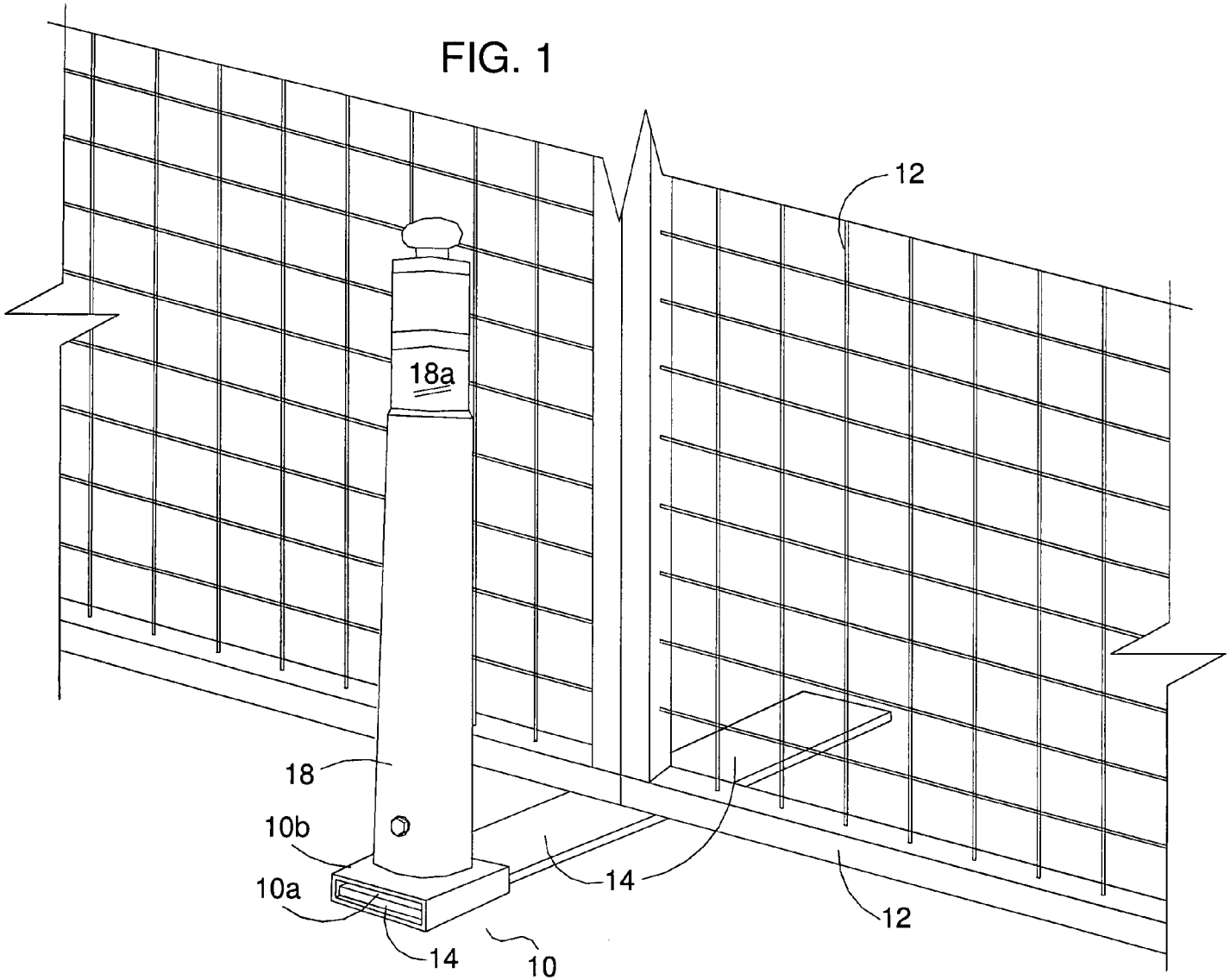
FIG. 1 is a perspective view of the preferred embodiment showing the invention mounted onto a construction site fence foot plate.
Figure 2:
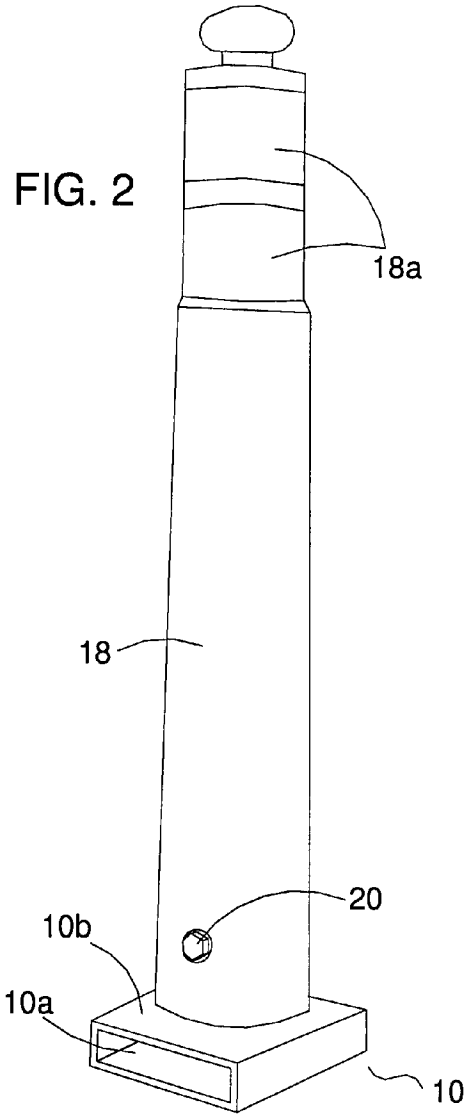
FIG. 2 is a perspective view of the preferred embodiment showing the invention un-mounted.

The construction site fence panel foot base unit is generally referred to as 10 as shown in a perspective view in FIG. 1. A construction site fence 12 is shown in partial view where fence 12 has a foot plate 14, where base unit 10 is attached thereon foot plate 14 through aperture 10*a* and a traffic delineator 18 is attached on base unit 10. FIG. 2 shows delineator 18 attached onto base unit 10 and un-attached from fence foot plate 14. Delineator 18 includes reflector tape 18*a*.

Figure 3:
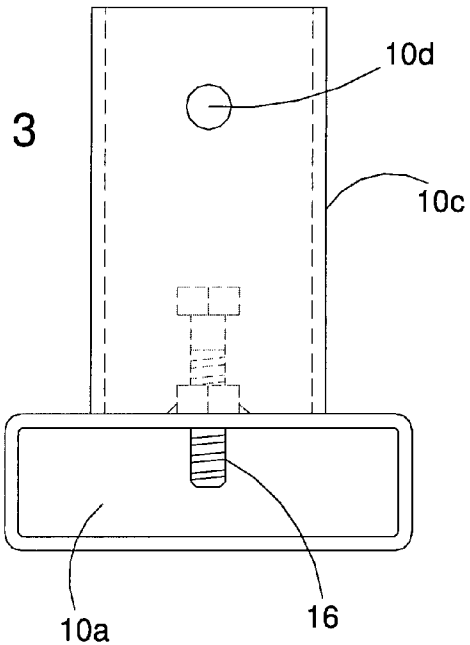
FIG. 3 is an elevation view of the preferred embodiment without a delineator attached.
Figure 4:
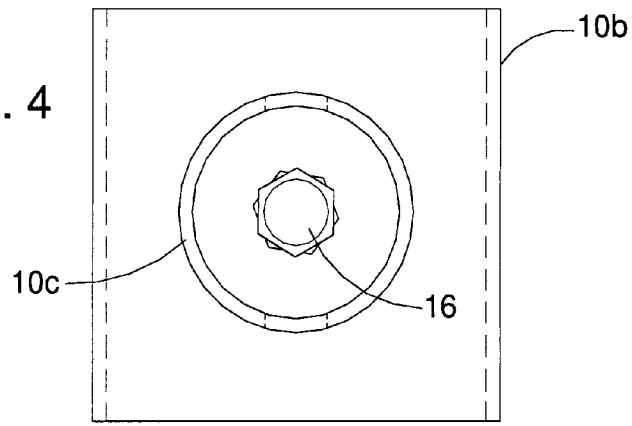
FIG. 4 is a plan view of the preferred embodiment without a delineator attached.

As best seen in FIG. 3 and FIG. 4, base unit 10 includes a section of rectangle tubing or sleeve 10*b*, a delineator attachment tube 10*c*, a fence foot plate clamping fastener 16, threaded at the top center of sleeve 10*b* and at the bottom center of tube 10*c*. Delineator attachment tube 10*c* includes a delineator fastener hole 10*d*.

Figure 6:
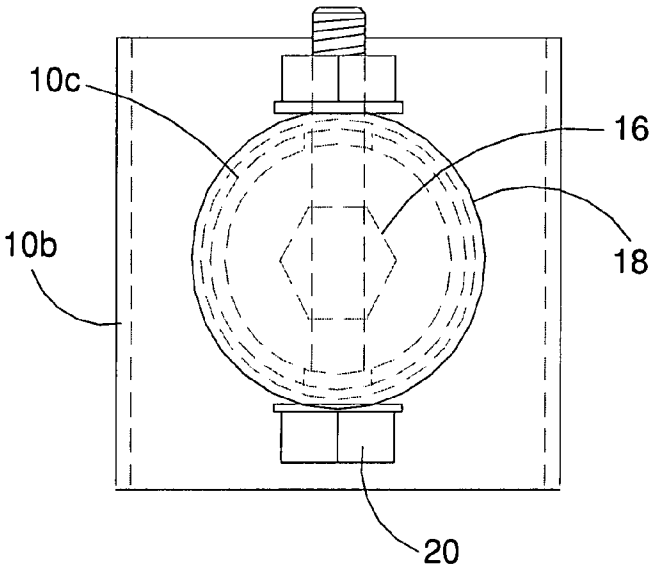
FIG. 6 is a plan view of the preferred embodiment with a delineator attached.
Figure 5:
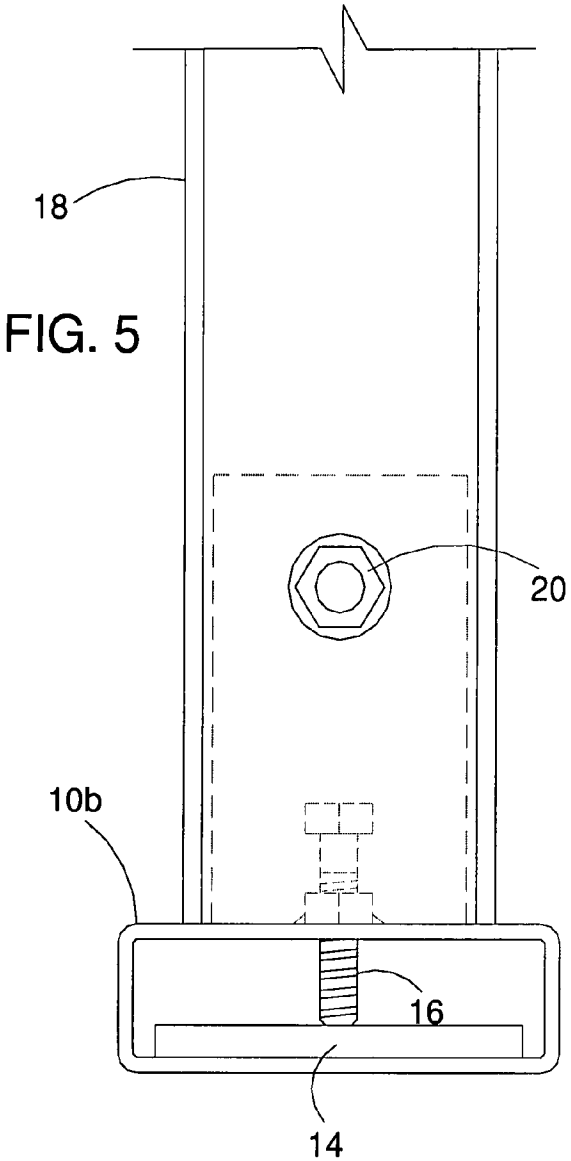
FIG. 5 is an elevation view of the preferred embodiment with a delineator attached shown in partial view.

As seen in FIG. 5 and FIG. 6, base unit 10 has delineator 18 attached, shown in partial view. Delineator 18 is longitudinally extending up from base unit sleeve 10*b* and is attached by delineator fastener 20.

Figure 7:
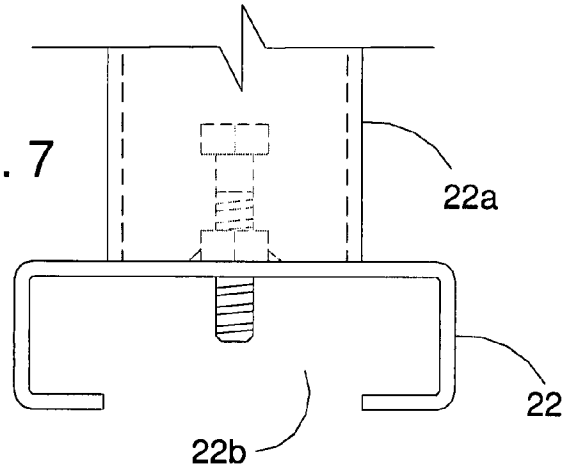
FIG. 7 is an elevation view of the preferred embodiment showing an alternate inverted C-shaped base.

As seen in FIG. 7, an alternate base unit uses a section of rectangle channel 22, a delineator attachment tube 22*a*, a fence foot plate aperture 22*b*.

Figure 8:
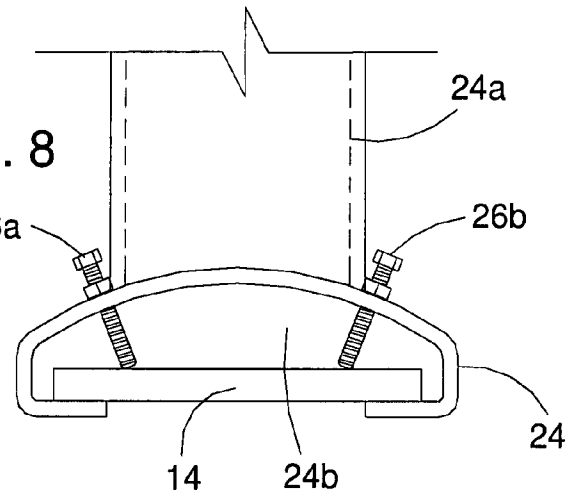
FIG. 8 is an elevation view of the preferred embodiment showing an alternate domed shaped base and with two quick-attach setscrews accessible from either side.

As seen in FIG. 8, an alternate base unit uses a section of domed channel 24, a delineator attachment tube 24*a*, a fence foot plate aperture 24*b*, and two foot plate clamp fasteners 26*a* and 26*b*.

Figure 9:
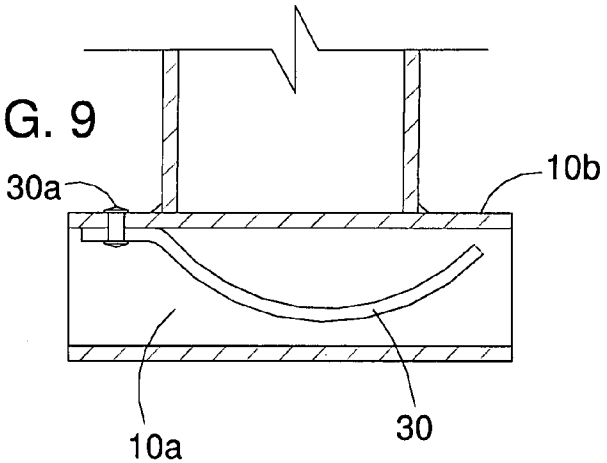
FIG. 9 is an elevation view of the preferred embodiment showing an alternate attachment method with a leaf spring for tool-less attachment.

As seen in FIG. 9, rectangle tubing 10*b* uses a quick-attach fastener, leaf spring 30 attached to the top of aperture 10*a* by fastener 30*a*.

Figure 10:
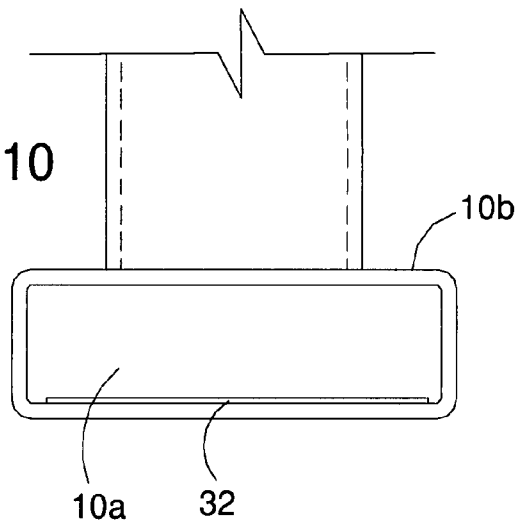
FIG. 10 is an elevation view of the preferred embodiment showing an alternate attachment method with a magnetic strip, also for tool-less attachment.

As seen in FIG. 10, rectangle tubing 10*b* uses an alternate quick-attach fastener, a magnetic strip 32 attached to the bottom of aperture 10*a*.

Figure 11:
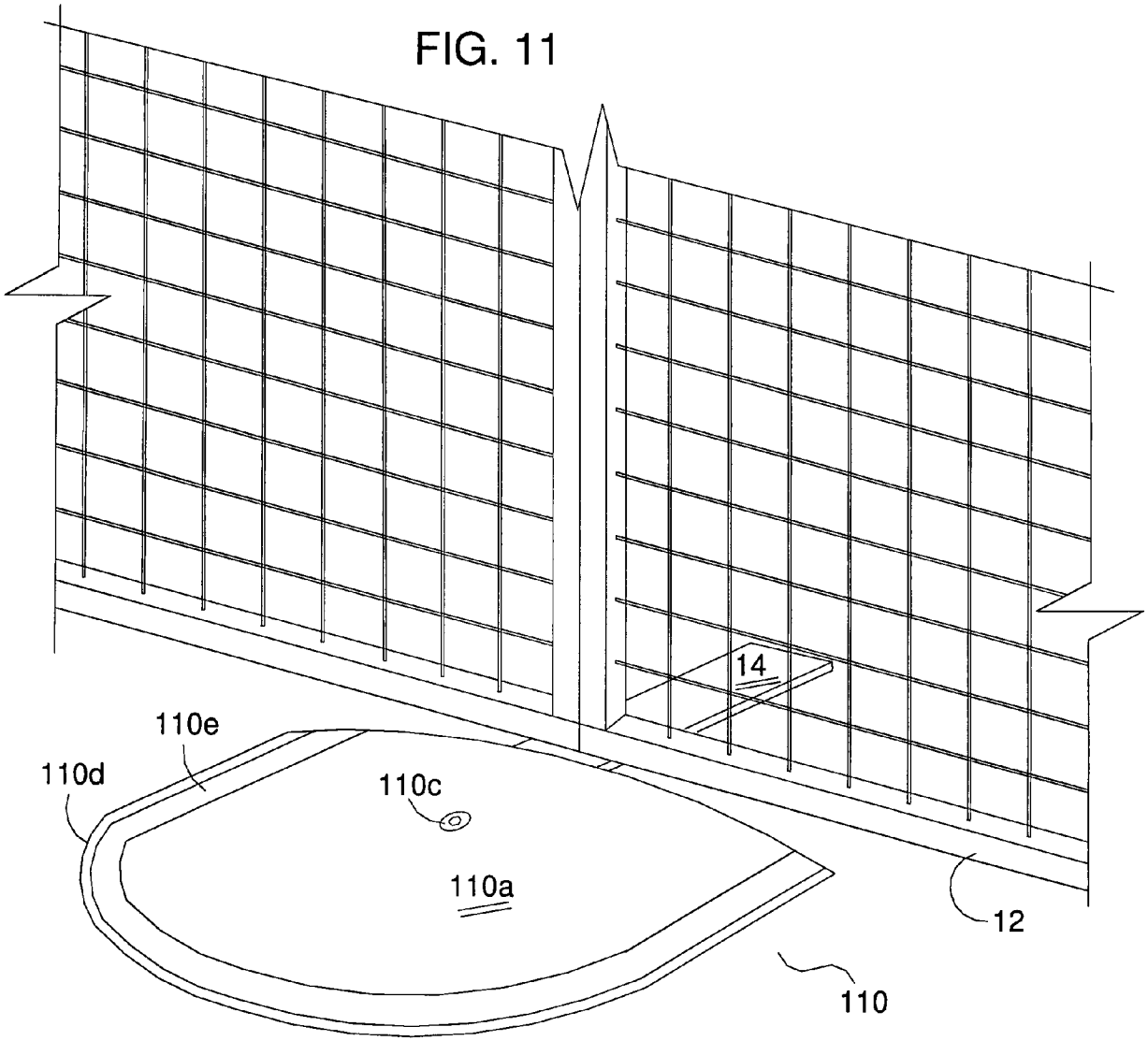
FIG. 11 is a perspective view of an alternate construction site fence foot plate base unit without a delineator, showing the invention mounted onto a construction site fence foot plate.
Figure 12:
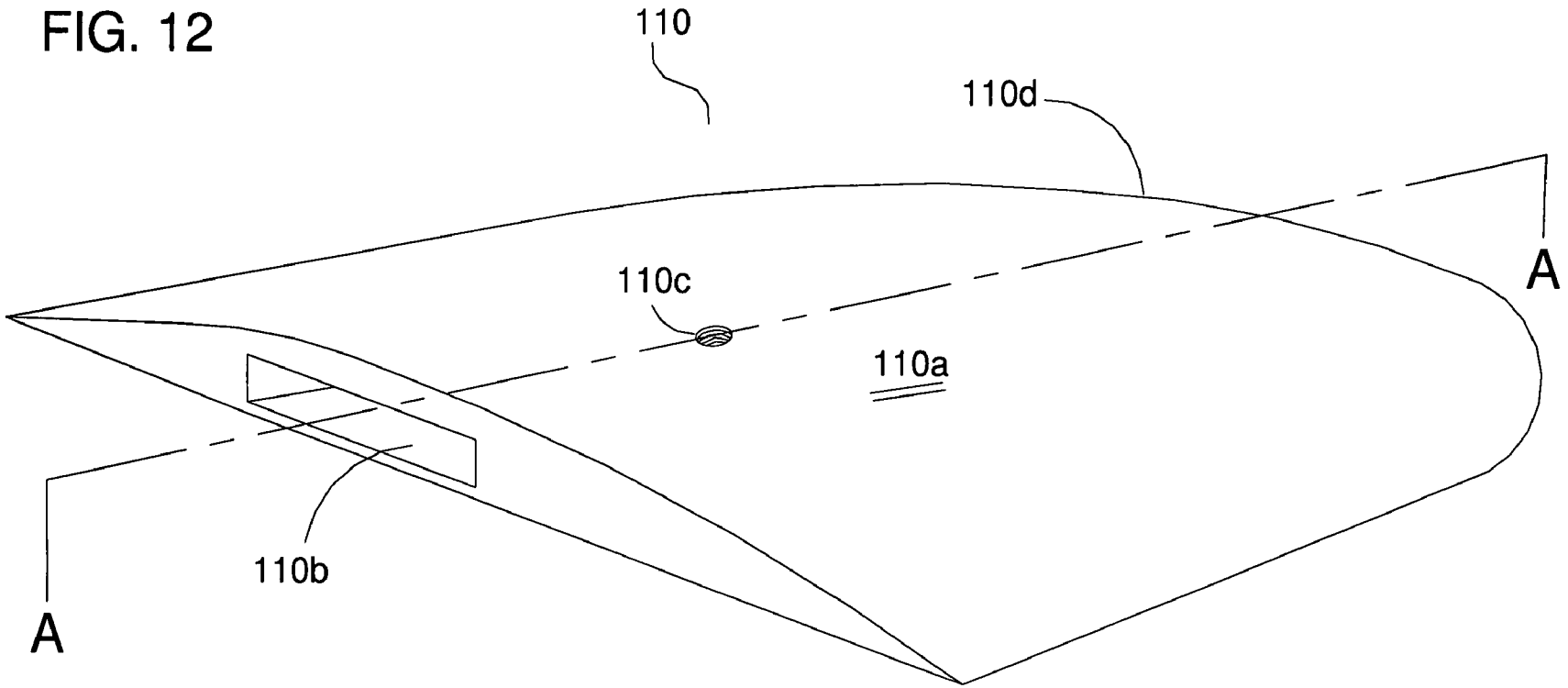
FIG. 12 is a perspective view of the alternate construction site fence foot plate base unit without a delineator, showing the invention un-mounted.
Figure 13:
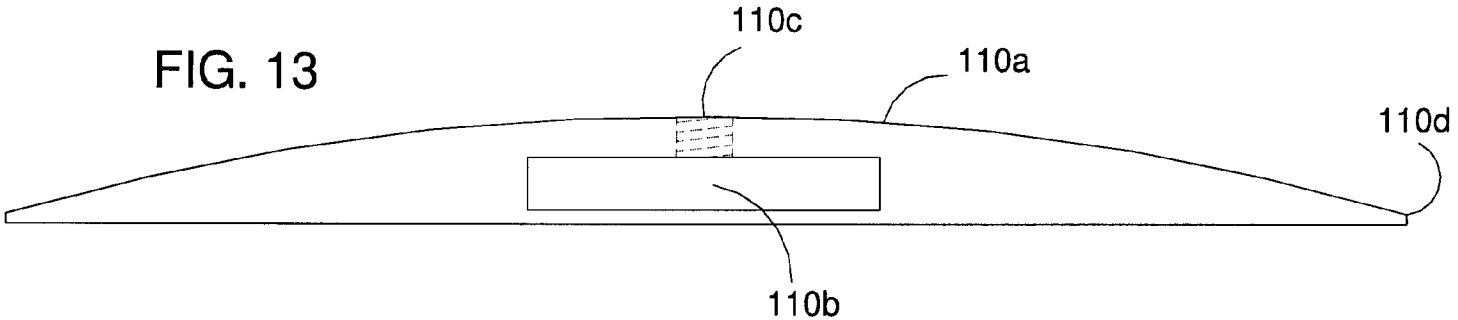
FIG. 13 is an elevation view from the back side of the alternate construction site fence foot plate base unit of FIG. 12.
Figure 14:
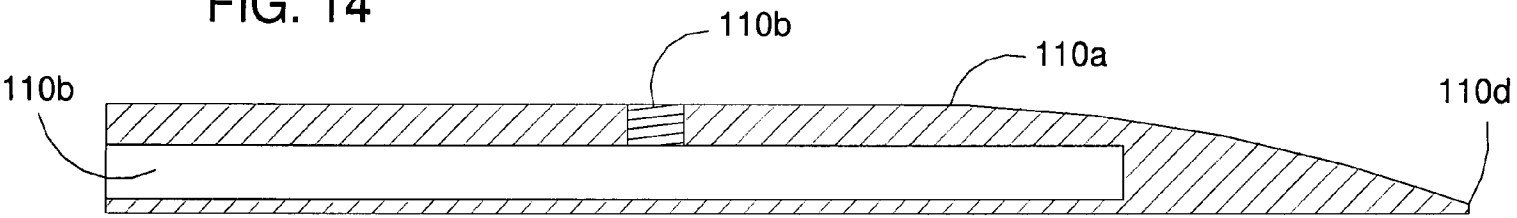
FIG. 14 is a cross-sectional view of the alternate construction site fence foot plate base unit taken along line A from FIG. 12 showing a threaded fastener.

As best seen in FIGS. 11, 12, 13 and 14, a second embodiment of the present invention, the construction site fence panel foot base unit 110 is designed to cover the fence foot plate 14. Base unit 110 consists of a gradually sloping pad 110*a*. Base unit 110 includes aperture 110*b* that slides over the fence foot plate 14. Base unit pad 110*a* tapers away from the top of base unit 110 where threaded fastener 110*c* is located, out to the base unit pad edges 110*d*. As seen in FIG. 11 base unit 110 may include a high visibility reflector strip 110*e* located around base unit edges 110*d*.

Figure 15:
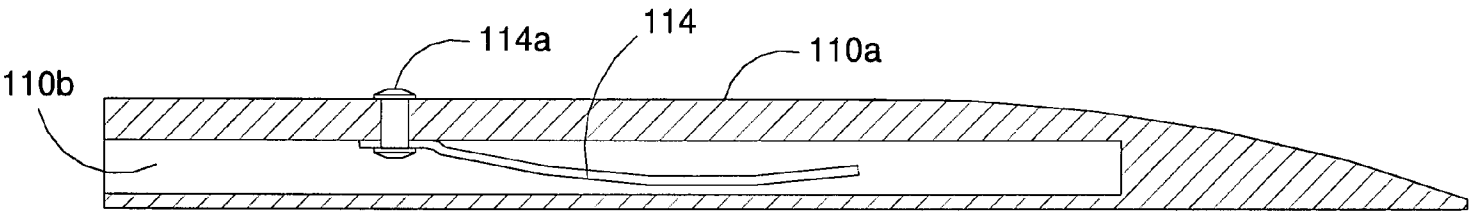
FIG. 15 is a cross-sectional view of the alternate construction site fence foot plate base unit taken along line A from FIG. 12, showing a leaf spring for tool-less attachment.

As seen in FIG. 15 base unit 110 may use a quick-attach fastener, leaf spring 114 which is attached to the top of aperture 110*b* by fastener 114*a*.

Figure 16:
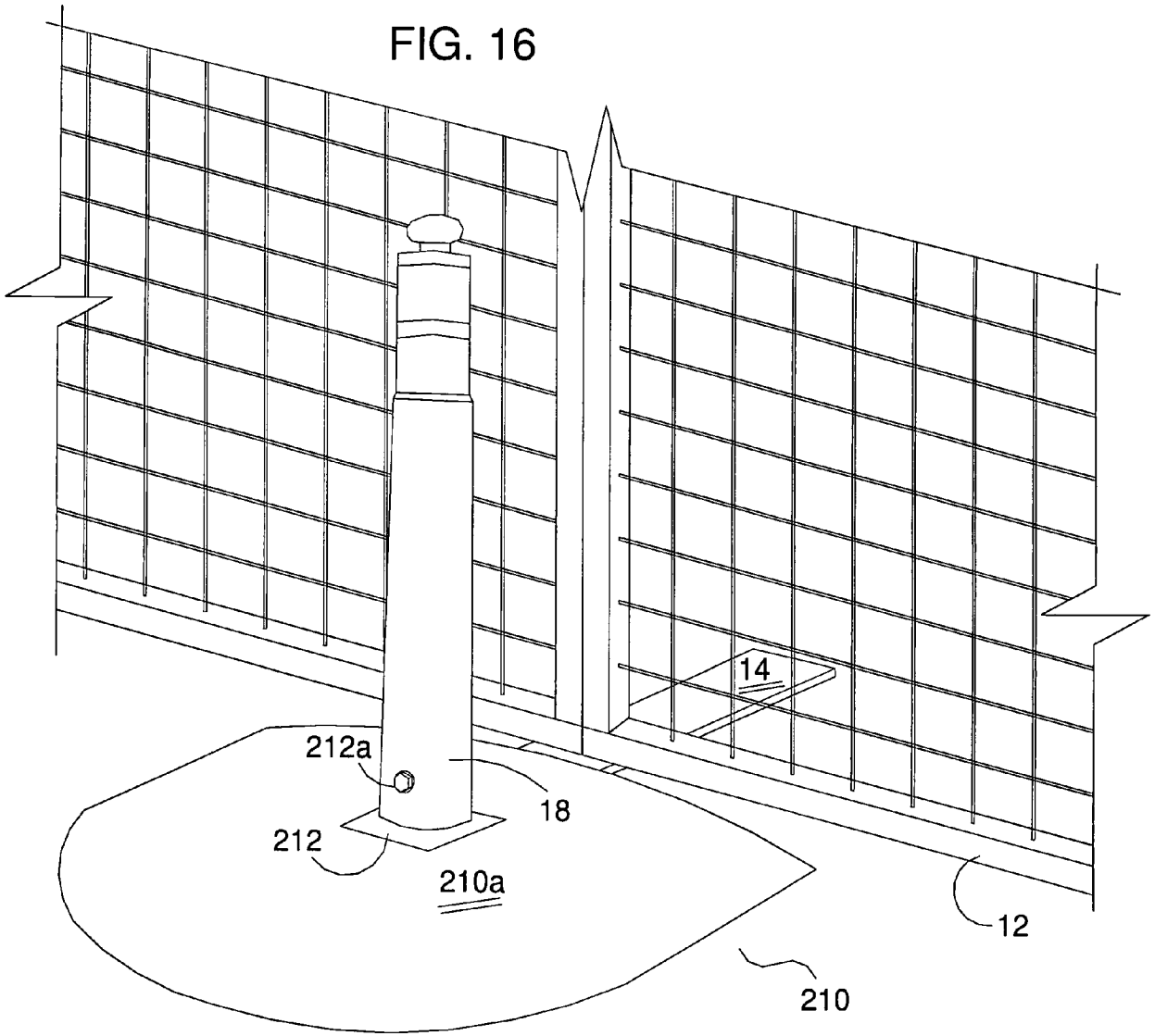
FIG. 16 is a perspective view of an alternate construction site fence foot plate base unit having a delineator with a base mount, and showing the invention mounted onto a construction site fence foot.

As best seen in FIG. 16, a third embodiment of the present invention, the construction site fence panel foot base unit 210 is combined with a traffic delineator mount 212 attached near the center of pad 210*a* of the base unit 210. Delineator mount 212 protrudes above pad 210*a* and includes a fastener 212*a* through delineator mount 212, which attaches traffic delineator 18.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

It is intended that the scope of the invention be defined by the Claims appended hereto and their equivalents.

The invention claimed is:

1. A construction site fence assembly comprising:

a construction site fence panel;

a fence panel foot plate attached to said construction site fence panel;

an attachable and releasable base attachment unit mounted onto said fence panel foot plate; and a traffic delineator mounted to said base attachment unit;

wherein said base attachment unit has an aperture through which said fence panel foot plate is matingly affixed so as to connect said base attachment unit to said fence panel foot plate, said aperture comprising a top roof, two side walls and a bottom floor;

wherein said base attachment unit further comprises an upward protruding traffic delineator attachment mount attached on top of said base attachment unit; and wherein said traffic delineator attachment mount includes a fastener fastening said traffic delineator to said traffic delineator attachment mount.

2. The construction site fence assembly of claim 1, wherein said bottom floor of said aperture is defined by a bottom floor portion extending from each said side wall toward one another so as to define a generally C-shape for said base attachment unit.

3. The construction site fence assembly of claim 1, wherein said upward protruding traffic delineator attachment mount is a cylindrical tube.

* * * * *